US008251220B2

(12) United States Patent
Ting et al.

(10) Patent No.: US 8,251,220 B2
(45) Date of Patent: Aug. 28, 2012

(54) PACKING STRUCTURE

(75) Inventors: Chung-Kuan Ting, Hsin-Chu (TW); Shih-Chi Chen, Hsin-Chu (TW)

(73) Assignee: AU Optronics Corporation, Hsin-Chu (TW)

( * ) Notice: Subject to any disclaimer, the term of this patent is extended or adjusted under 35 U.S.C. 154(b) by 156 days.

(21) Appl. No.: 12/831,319

(22) Filed: Jul. 7, 2010

(65) Prior Publication Data

US 2011/0056868 A1 Mar. 10, 2011

(30) Foreign Application Priority Data

Sep. 4, 2009 (TW) ..... 98129902 A

(51) Int. Cl.
*B65D 81/02* (2006.01)
*B65D 81/107* (2006.01)

(52) U.S. Cl. ..... 206/587; 206/454; 206/521

(58) Field of Classification Search ..... 206/587, 206/454, 455, 449, 453, 456, 483, 488, 586, 206/523, 521, 583, 591, 592
See application file for complete search history.

(56) References Cited

U.S. PATENT DOCUMENTS

| | | | | |
|---|---|---|---|---|
| 3,356,209 | A * | 12/1967 | Pezely, Jr. | 206/523 |
| 3,701,465 | A * | 10/1972 | Richter | 206/521 |
| 4,610,355 | A * | 9/1986 | Maurer | 206/386 |
| 4,892,193 | A * | 1/1990 | Thomas | 206/453 |
| 5,339,958 | A * | 8/1994 | Taravella et al. | 206/521 |
| 6,116,423 | A * | 9/2000 | Troxtell et al. | 206/523 |
| 7,588,148 | B2 * | 9/2009 | Yang | 206/523 |
| 7,591,373 | B2 * | 9/2009 | Horiuchi | 206/576 |
| 7,810,639 | B2 * | 10/2010 | Djulaini et al. | 206/307 |
| 7,946,426 | B2 * | 5/2011 | Ohsawa et al. | 206/586 |
| 2004/0069668 | A1 * | 4/2004 | Finnigan | 206/372 |
| 2005/0087470 | A1 * | 4/2005 | Chuang et al. | 206/503 |

FOREIGN PATENT DOCUMENTS

| | | | |
|---|---|---|---|
| CN | 2741902 | Y | 11/2005 |
| JP | 2001-31175 | A | 2/2001 |
| JP | 2002-284148 | A | 10/2002 |
| JP | 2005313942 | A | 11/2005 |
| TW | M341003 | | 9/2008 |
| TW | M357432 | | 5/2009 |
| TW | I310358 | | 6/2009 |

OTHER PUBLICATIONS

Chinese language Office Action dated Sep. 2, 2010.

* cited by examiner

*Primary Examiner* — Steven A. Reynolds
(74) *Attorney, Agent, or Firm* — Thomas, Kayden, Horstemeyer & Risley, LLP

(57) ABSTRACT

A packing structure includes a housing and a cushion portion. The housing includes a bottom plate and a sidewall while the cushion portion is disposed on the bottom plate of the housing. A groove and a jaw portion are formed on an end portion of the cushion portion. The jaw portion is located on a side of the groove facing the sidewall and extends away from the bottom plate. A first tongue plate is formed on the sidewall of the housing and bends inward. A free end of the first tongue plate enters the groove through an opening of the groove, wherein a backside of the jaw portion interferes with the first tongue plate to restrict the first tongue plate from leaving the groove. When the cushion portion is under external forces and moves away from the bottom plate, the first tongue plate will support a bottom inner surface within the groove to restrict a displacement of the cushion portion away from the bottom plate.

35 Claims, 12 Drawing Sheets

PACKING STRUCTURE

BACKGROUND OF THE INVENTION

1. Field of the Invention

This invention relates to a packing structure; specifically, the present invention relates to packing structures for containing display panel or other fragile items and can be easily disassembled.

2. Description of the Prior Art

Packing fragile items has always been one of the important issues in transporting goods. Poor packing may often cause the items to be damaged and therefore increase the production costs. Especially stresses may concentrate on fragile items with special size and shape such as liquid crystal glass or display panels and damage the items.

Conventionally, when transporting the display panels, normally the box to be transported will contain shock absorbing material such as Styrofoam to reduce the direct impact of external forces on the display panel. As FIG. 1 shows, the conventional packing structure includes an outer box 10, an inner box 20 and a cushion portion 30. The cushion portion 30 is disposed in the inner box 20 and the outer box 10 covers the inner box 20 and the cushion portion 30. When packing, the display panel 11 is protected by the cushion portion 30. However, in order to economize the use of cushion portion 30, the cushion portion 30 is normally used to partially and not completely fill the inner box 20. In this way, fixing the cushion portion 30 with the inner box 20 is relatively important. Normally adhesive is used to fix the cushion portion 30 onto the inner box 20. However, the cushion portion 30 adhered to the inner box 20 is not easy to be detached from the inner box 20 and thus requires greater waste disposal space. Furthermore, due to the fact that the cushion portion 30 is not easy to be detached, the cushion portion 30 becomes waste that cannot be recycled resulting in environmental problems.

SUMMARY OF THE INVENTION

It is an object of the present invention to provide a packing structure which can be easily dismantled.

It is another object of the present invention to provide a packing structure in which the cushion portion is reliably positioned.

It is yet another object of the present invention to provide a packing structure to economize space for waste disposal.

The packing structure of the present invention includes a housing and a cushion portion. The housing includes a bottom plate and a sidewall, wherein the sidewall is connected to the bottom plate together to include an angle. The cushion portion is disposed on the bottom of the housing, wherein two ends of the cushion portion contact two side wall of the housing, respectively. A groove and a jaw portion are formed on an end portion of the cushion portion. The groove extends inward from the end portion and tilts toward the bottom plate. The jaw portion is located on one side of the groove facing the side wall of the housing and extends away from the bottom plate. Top end of the jaw portion and the end portion of the cushion portion are encircled to form an opening of the groove at the end portion and form two sides of the opening.

A first tongue plate is formed on the side wall of the housing. Bottom of the first tongue plate is connected to the side wall and bends inward. A free end of the first tongue plate extends obliquely toward the bottom plate of the housing. The first tongue plate enters the groove through the opening of the groove, wherein the back surface and top end of the jaw portion interfere with the first tongue plate to restrict the first tongue plate from leaving the groove. When the cushion portion is under an external force and moves away from the bottom plate, the first tongue plate will contact an inner surface at the bottom of the groove to generate a reaction force to be transmitted to the side wall and limit the displacement of the cushion portion away from the bottom plate. Furthermore, a first side and a second side of the first tongue plate contact a first stopper and a second stopper of the cushion portion to limit the displacement of the cushion portion.

By the above-mentioned design, the engagement between the first tongue plate and the groove limits the lateral displacement and the upward displacement of the cushion portion from the bottom plate. Furthermore, due to the fact that the bottom plate is disposed at the bottom of the cushion portion, thus the cushion portion is restricted from moving downward. In this way, since most of the directions are limited to displacement, when the first tongue plate and the groove are coupled, the cushion portion will be positioned in the housing and will not be able to generate displacement. Furthermore, the assembly of the packing structure only needs to push the first tongue plate into the groove while the disassembly of the packing structure only requires pushing the first tongue plate out of the jaw portion. In this way, the convenience of assembling and dismantling the packing structure is greatly improved.

The packing structure further includes an outer container. A first housing and a second housing are disposed at two opposite ends of the outer container. The first housing and the second housing are coupled with the cushion portion in the same way as used to couple the tongue plate with the groove. When display panels or other items about to be boxed or transported are placed in the container, the cushion portion located at two ends of the container can provide the display panels or other items with protection in different directions and reduce the impact by external forces.

DETAILED DESCRIPTION OF THE PREFERRED EMBODIMENT

The present invention provides a packing structure preferably used in packing box structure. However, in different embodiments, the packing structure of the present invention can be used as a single cushioning packing material. In a preferred embodiment, the packing structure of the present invention is used to pack fragile plate-like items such as liquid crystal glass, display panel or general glass. However, in different embodiments, the packing structure of the present invention can be used to pack fragile items in other shapes.

Figure 1:
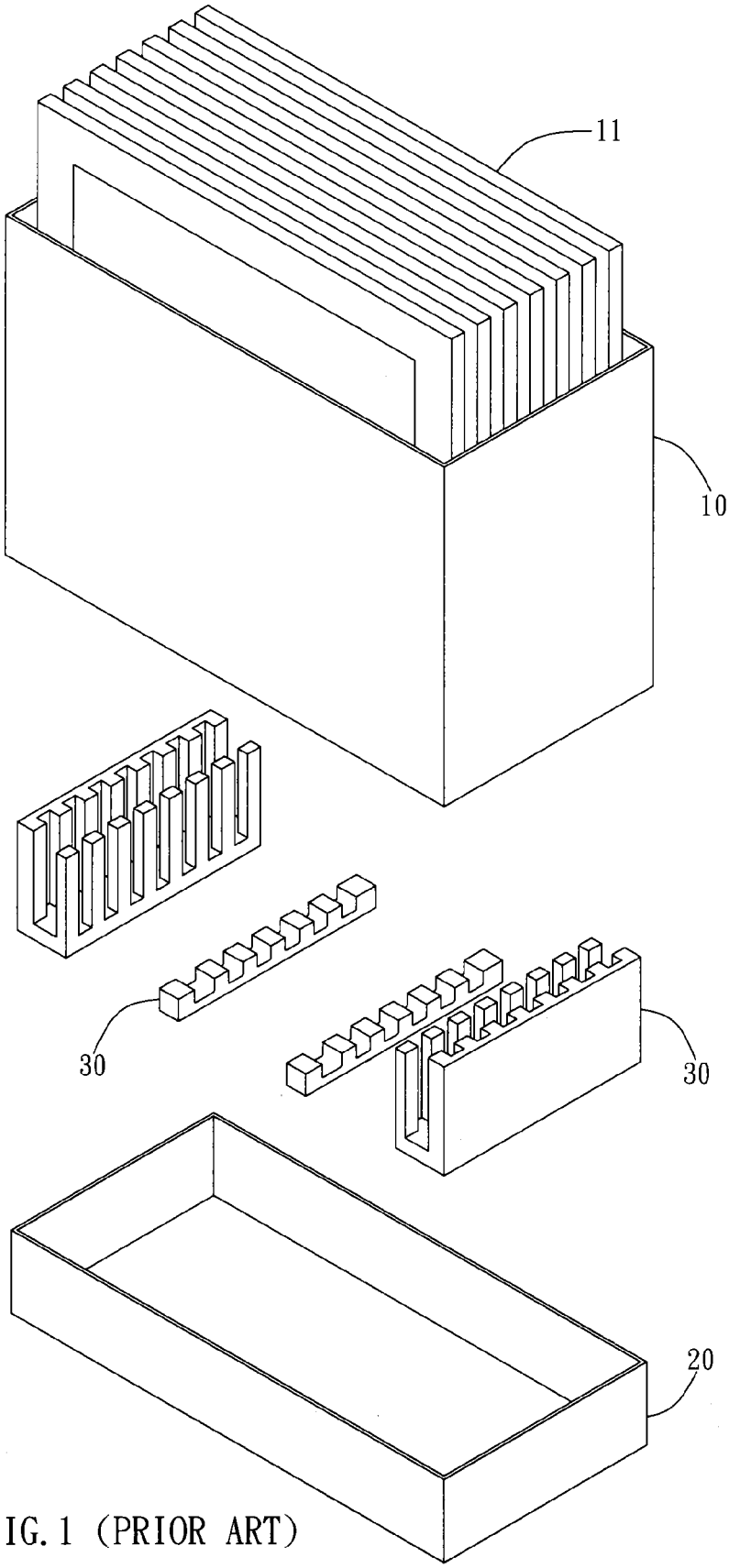
FIG. 1 (PRIOR ART)
FIG. 1 is a schematic view of a conventional packing structure.
Figure 2:
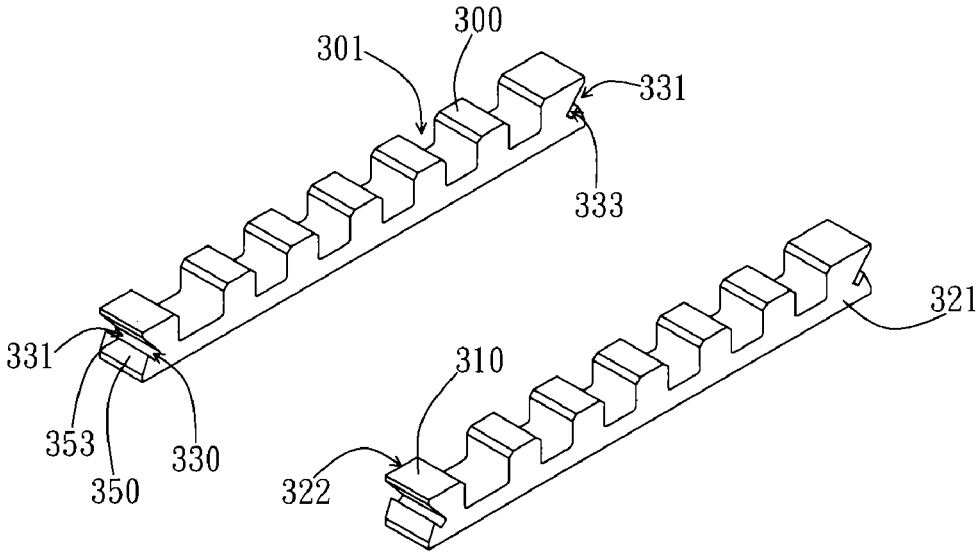
FIG. 2 is an exploded view of a packing structure in one embodiment of the present invention.
Figure 2:
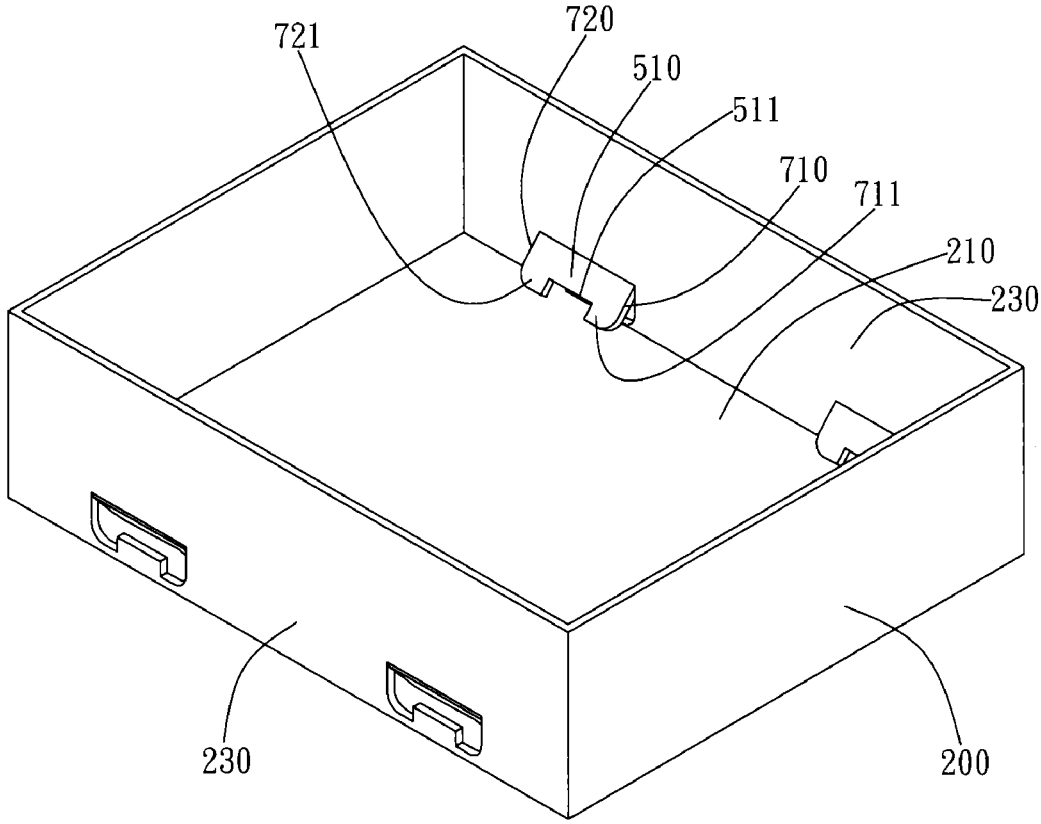

In the embodiment illustrated in FIG. 2, the packing structure includes a housing 200 and a cushion portion 300. The housing 200 includes a bottom plate 210 and a sidewall 230, wherein the sidewall 230 is connected to the bottom plate to include an angle. In the present embodiment, the sidewall 230 bends at one end of the bottom plate 210 and extends upward to be perpendicular to the bottom plate 210. Furthermore, the housing 200 is preferably made of cardboard. In different embodiments, the housing 200 can be made of plastic or other materials.

As FIG. 2 shows, the cushion portion 300 is disposed on the bottom plate 210 of the housing 200. The cushion portion 300 is preferably an elongated body, wherein two ends of the cushion portion 300 respectively contact two sidewalls 230 of the housing 200. In the present embodiment, the bottom plate 210 is rectangular and thus the cushion portion 300 is a rectangle located across the bottom plate 210. A plurality of troughs 301 are preferably formed on top end of the cushion portion 300, wherein the groove 301 can be used to position the display panel or other items to be boxed or transported. Two ends of the cushion portion 300 are respectively formed with a first stopper 321 and a second stopper 322. The first stopper 321 and the second stopper 322 are preferably two opposite lateral surfaces of the cushion portion 300, but can also be other structures disposed on the cushion portion 300. In preferred embodiments, the cushion portion 300 is made of Expanded Poly-Propylene (EPP), but can also be made of other organic resins or rubber materials.

Figure 3:
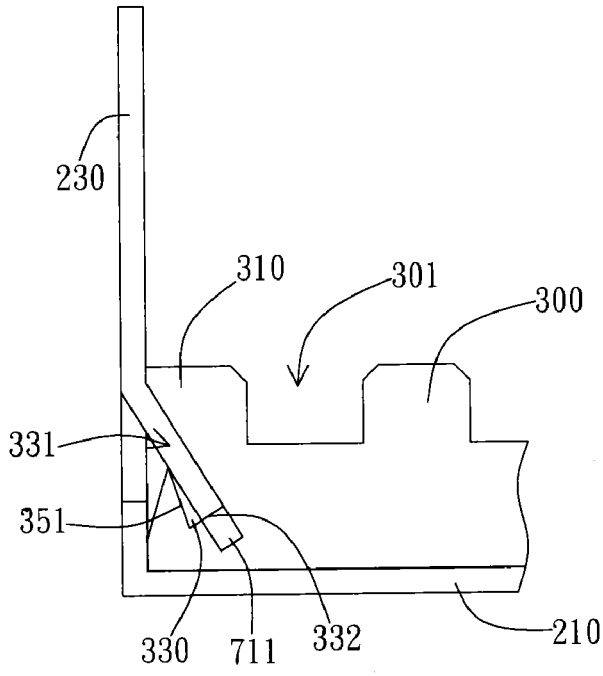
FIG. 3 is a cross-sectional view of the packing structure in one embodiment of the present invention.

In the embodiment illustrated in FIG. 2, a groove 330 and a jaw portion 350 are formed on the end portion 310 of the cushion portion 300. As FIG. 2 and FIG. 3 show, the groove 330 extends from the end portion 310 into the cushion portion 300 and tilts toward the bottom plate 210. The groove 330 tilts at angles between 0° and 90° and preferably between 30° and 45°. In the present embodiment, the cross-section of the groove 330 extends in a straight line. However, in different embodiments, the cross-section of the groove 330 can extend upward or in an upward curve. The jaw portion 350 is located on one side of the groove 330 facing the housing 200 and extends in a direction away from the bottom plate 210. In other words, a back surface 351 of the jaw portion 350 serves as an inner surface of the groove 330 and a backside bottom of the jaw portion 350 is connected to the body of the cushion portion 300. Since the groove 330 is formed on the back side of the jaw portion 350 and only the backside bottom of the jaw portion 350 is connected to the body of the cushion portion 300, the jaw portion 350 is allowed be deformable with respect to the groove 330 when pushing outward or pressed. Furthermore, in addition to the structural design, the jaw portion 350 is preferably elastic so that the jaw portion 350 can return to default position when the external force is released.

As FIG. 2 and FIG. 3 show, the top end 353 of the jaw portion 350 and the end portion 310 together form an opening 331 of the groove 330 at the end portion 310, wherein the top end 353 and the end portion 310 are respectively located above and below the opening 331. In the present embodiment, the opening 331 of the groove 330 at the end portion 310 crosscuts the surface of the entire end portion 310 and extends to the first stopper 321 as well as the second stopper 333 to form a lateral opening 322. However, in different embodiments, the opening 331 can be formed on only the surface of the end portion 310 so that rims of the opening 311 has a closed rim.

As FIG. 2 shows, a first tongue plate 510 is formed on the sidewall 230 of the housing 200. One end of the first tongue plate 510 is connected to the sidewall 230 and the first tongue plate 510 bends inward. A free end 511 of the first tongue plate 510 extends obliquely toward the bottom plate 210 of the housing 200. In a preferred embodiment, the first tongue plate 510 can be cut out from the sidewall 230; wherein one end of the first tongue plate 510 is left connected to the sidewall 230 while the rest of the first tongue plate 510 is pushed inward to form the first tongue plate 510. However, in different embodiments, the first tongue plate 510 can be adhered, fixed or assembled to the sidewall 230 by other methods.

As FIG. 3 shows, the first tongue plate 510 enters the groove 330 through the opening 331 of the groove 330, wherein the backsurface 351 and the top end 353 of the jaw portion 350 interfere with the first tongue plate 510 to restrict the first tongue plate 510 from leaving the groove 330. In other words, the first tongue plate 510 will require an adequate length which is preferably longer than a straight-line distance from the root of the first tongue plate 510 to the top end 353 of the jaw portion 350. Thus when the first tongue plate 510 is inserted into the groove 330, the first tongue plate 510 will compel the jaw portion 350 to rotate, move or deform so that the first tongue plate 510 can enter the groove 330. After the first tongue plate 510 enters the groove 330, the jaw portion 350 will return to its default position to restrict the first tongue plate 510 from leaving the groove 330.

Figure 4:
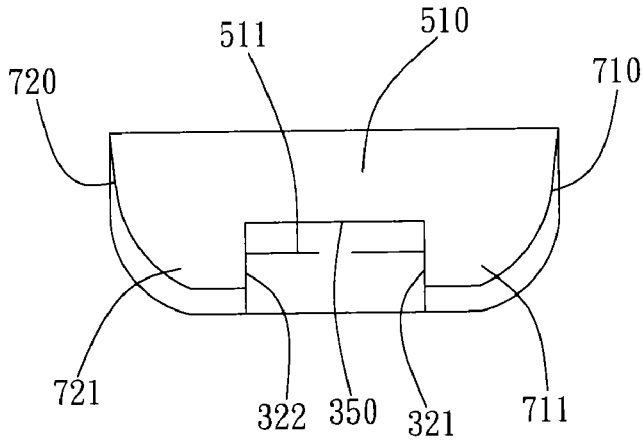
FIG. 4 is a front view of the packing structure in one embodiment of the present invention.

As FIG. 3 shows, the free end 511 of the first tongue plate 510 contacts the bottom of the inner surface 332 within the groove 330. When the cushion portion 300 is compelled by external forces to move away from the bottom plate 210, the first tongue plate 510 supports the bottom inner surface 332 of the groove 330 to generate reaction forces to the sidewall 230. Therefore, a displacement of the cushion portion 300 away from the bottom plate 210 can be limited. Furthermore, a first side 710 and a second side 720 of the first tongue plate 510 respectively contact the first stopper 321 and the second stopper 322 of the cushion portion 300 to limit a displacement of the cushion portion 300. As FIG. 2 and FIG. 4 shows, a first protruding portion 711 is formed on the first side 710 of the first tongue plate 510 while a second protruding portion 721 is formed on the second side 720 and protrudes over the free end 511. As FIG. 4 shows, the width of the first tongue plate 510 is greater than the opening width of the opening 331 of the groove 330. The lateral openings 333 of the groove 330 on the first stopper 321 and the second stopper 322 communicate with the opening 331. Therefore, the first side 710 as well as the second side 720 can protrude out from the lateral openings 333. The first protruding portion 711 and the second protruding portion 721 respectively contact the outer surfaces of the first stopper 321 and the second stopper 322 near the groove 330. As FIG. 4 shows, the first protruding portion 711 and the second protruding portion 721 clamp the cushion portion 300 to limit the lateral displacement of the cushion portion 300.

From the design described above, the engagement between the first tongue plate 510 and the groove 330 limits the displacements away from the bottom plate 210 and toward two sides of the cushion portion 300. Furthermore, the bottom plate 210 is located below the cushion portion 300 and therefore the cushion portion 300 cannot move downward. In addition, the sidewalls are preferably formed in pairs while the cushion portion 300 is disposed between two opposite sidewalls 230. Thus the cushion portion 300 cannot move toward or away from the sidewall 230. Since displacements in most directions are limited, when the first tongue plate 510 couples with the groove 330, the cushion portion 300 can be properly positioned within the housing 200 and cannot generate displacement freely. Furthermore, the assembly only requires pushing the first tongue plate 510 into the groove 330 while disassembly only requires pulling the first tongue plate 510 out of the jaw portion 350. Therefore, the convenience of assembly and disassembly is greatly improved.

Figure 5A:
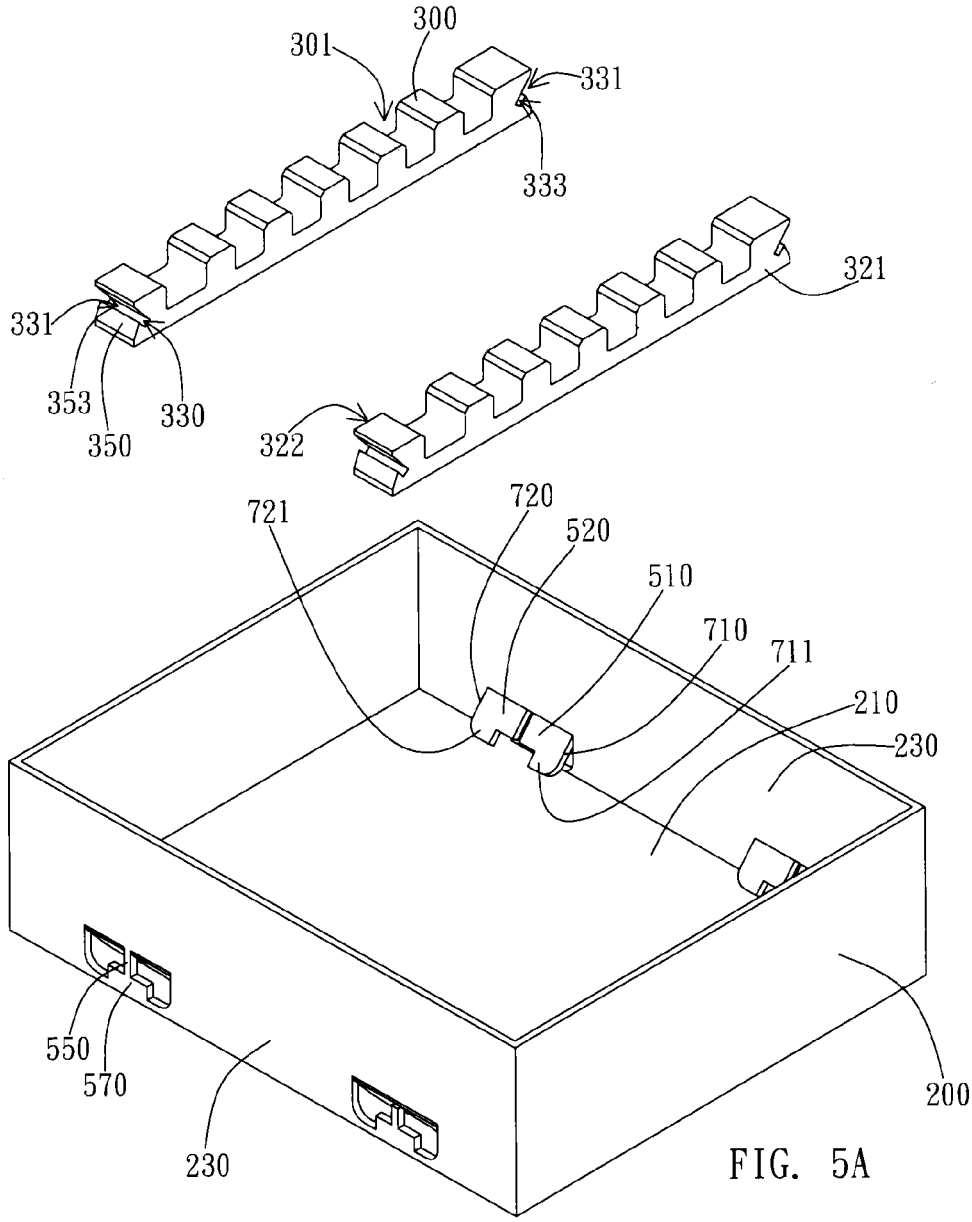
FIG. 5A is a schematic view illustrating a first tongue plate and a second tongue plate.
Figure 5B:
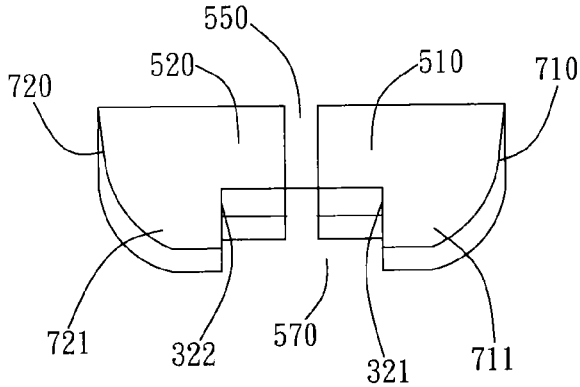
FIG. 5B is a front view of the embodiment illustrated in FIG. 5A.

In another embodiment illustrated in FIG. 5A and FIG. 5B, a second tongue plate 520 can be included in addition to the first tongue plate 510. In the present embodiment, the first tongue plate 510 and the second tongue plate 520 are formed symmetrically. However, in different embodiments, the first tongue plate 510 and the second tongue plate 520 can be formed asymmetrically under functional considerations by adjusting lengths, bending angle or structure of plates 510, 520. In the embodiment illustrated in FIG. 5A, the second tongue plate 520 is adjacent to the first tongue plate 510 and free ends 511, 521 of the two plates 510, 520 extend toward the bottom plate 210. However, in different embodiments, the second tongue plate 520 can be inverted so that the free end 521 extends in opposite direction. As FIG. 5A and FIG. 5B show, the first protruding portion 711 and the second protruding portion 721 are respectively formed on lateral sides of the first tongue plate 510 and the second tongue plate 520, wherein the protruding portions 711, 721 extend away from the free end 511, 521. When inserted into the groove 330, the first protruding portion 711 and the second protruding portion 721 clamp the cushion portion 300.

As FIG. 5A and FIG. 5B show, a bridging portion 550 is disposed between the first tongue plate 510 and the second tongue plate 520. Top and bottom ends of the bridging portion 550 are connected respectively to the sidewall 230 above and below the first tongue plate 510 and the second tongue plate 520. In a preferred embodiment, the first protruding portion 711 and the second protruding portion are cut out from the sidewall 230 with one end connected to the sidewall 230 and the rest pushed inward to form the first tongue plate 510 and the second tongue plate 520. While cutting out the first tongue plate 510 and the second tongue plate 520, part of the sidewall 230 can be reserved between the two tongue plates 510, 520 so that the bridging portion 550 can be formed when the first tongue plate 510 and the second tongue plate 520 are pushed inward. The bridging portion 550 allows the protruding part 570 left after cutting out the first tongue plate 510 and the second tongue plate 520 to remain connected to the sidewall 230 so as to prevent the protruding part 570 from bending.

Figure 6A:
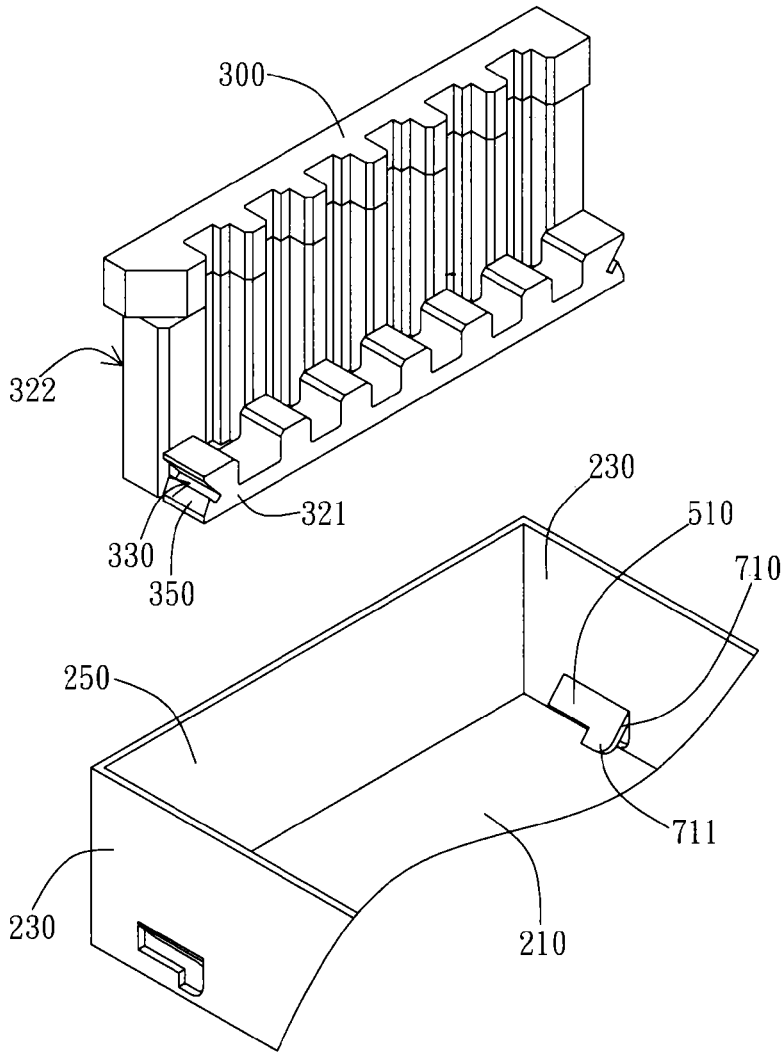
FIG. 6A is a schematic view illustrating a cushion portion about to make contact with a sidewall of the present invention.
Figure 6B:
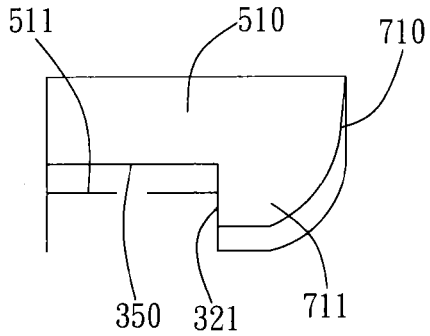
FIG. 6B is a front view of the embodiment illustrated in FIG. 6A.

In the embodiment illustrated in FIG. 6A and FIG. 6B, when the cushion portion 300 is disposed on the bottom of the housing 200 the structure of the first tongue plate 510 can be selectively adjusted. As FIG. 6A shows, other than the bottom plate 210 and the sidewall 230, the housing 200 also includes a back wall 250 perpendicular to the bottom plate 210 and the side wall 230, respectively. The back wall 250 is connected to the side wall 230 and are both in vertical position on the bottom plate 210. As FIG. 6A and FIG. 6B show, when the second stopper 322 of the cushion portion 300 is fitted to or contacts with the back wall 250, the first tongue plate 510 can have only the first side 710 can protrude from the first tongue plate 510 to form the first protruding portion 711, while the second side 720 does not protrude to form the second protruding portion 721. In the present embodiment, one side of the cushion portion 300 leans on the back wall 250 of the housing 200, and thus even the cushion portion 300 cannot move toward the second side 720.

Figure 7A:
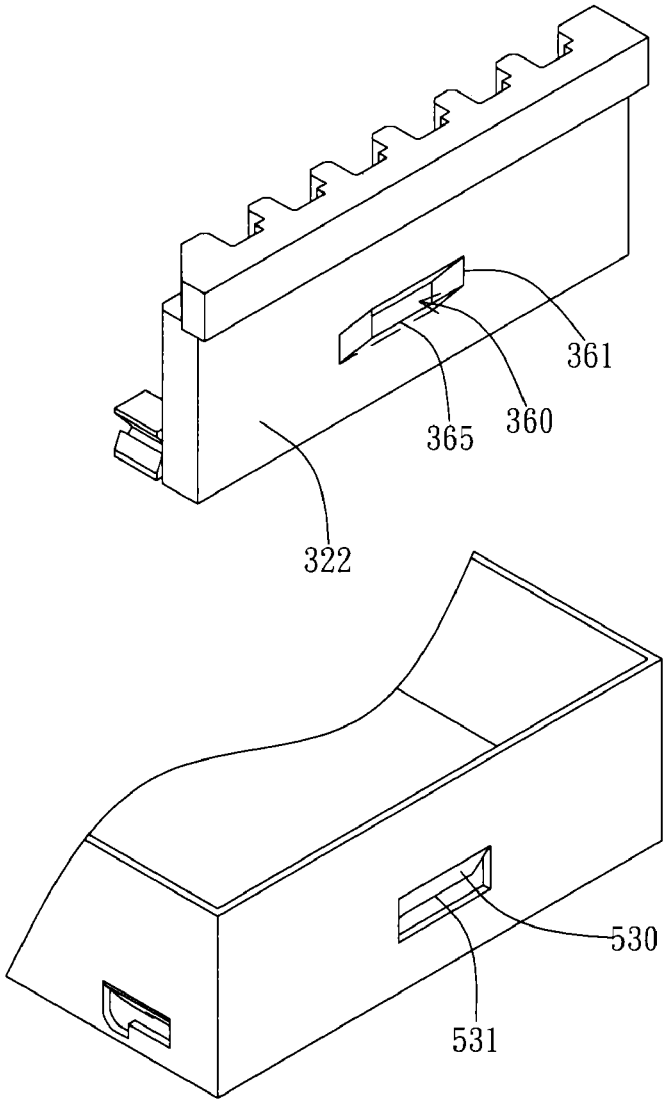
FIG. 7A and FIG. 7B are schematic views of the packing structure having a third tongue plate.
Figure 7B:
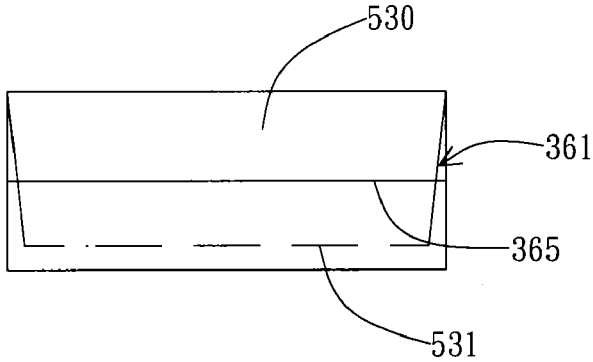

In the embodiment illustrated in FIG. 7, when the second stopper 322 of the cushion portion 300 makes contact with the back wall 250, a third tongue plate 530 can also be formed on the track wall 260. Similar to the first tongue plate 510, the third tongue plate 530 bends inward and has a free end 531 extending toward the bottom plate 210. A backside groove 360 is formed on the second stopper 322 and a backside jaw portion 365 is formed on one side of the backside groove 365 facing the back wall 250. The backside jaw portion 365 extends in a direction away from the bottom plate 210 while its top end and the second stopper 322 together form a backside opening 361 of the backside groove 360. The relationship between the third tongue plate 530, the backside groove 360, and the backside jaw portion 365 is similar to that between the first tongue plate 510 and the groove 330. As FIG. 7 shows, the third tongue plate 530 can enter the backside groove 360 through the backside opening 361 while the backside jaw portion 365 interferes with the third tongue plate 530 to restrict the third tongue plate 530 from leaving the backside groove 360. When external force is applied to remove the cushion portion 300 from the housing 200, the free end 531 of the third tongue plate 530 will contact the inner surface of the backside groove 360 and limit the displacement of the cushion portion away from the bottom plate 210.

Figure 8A:
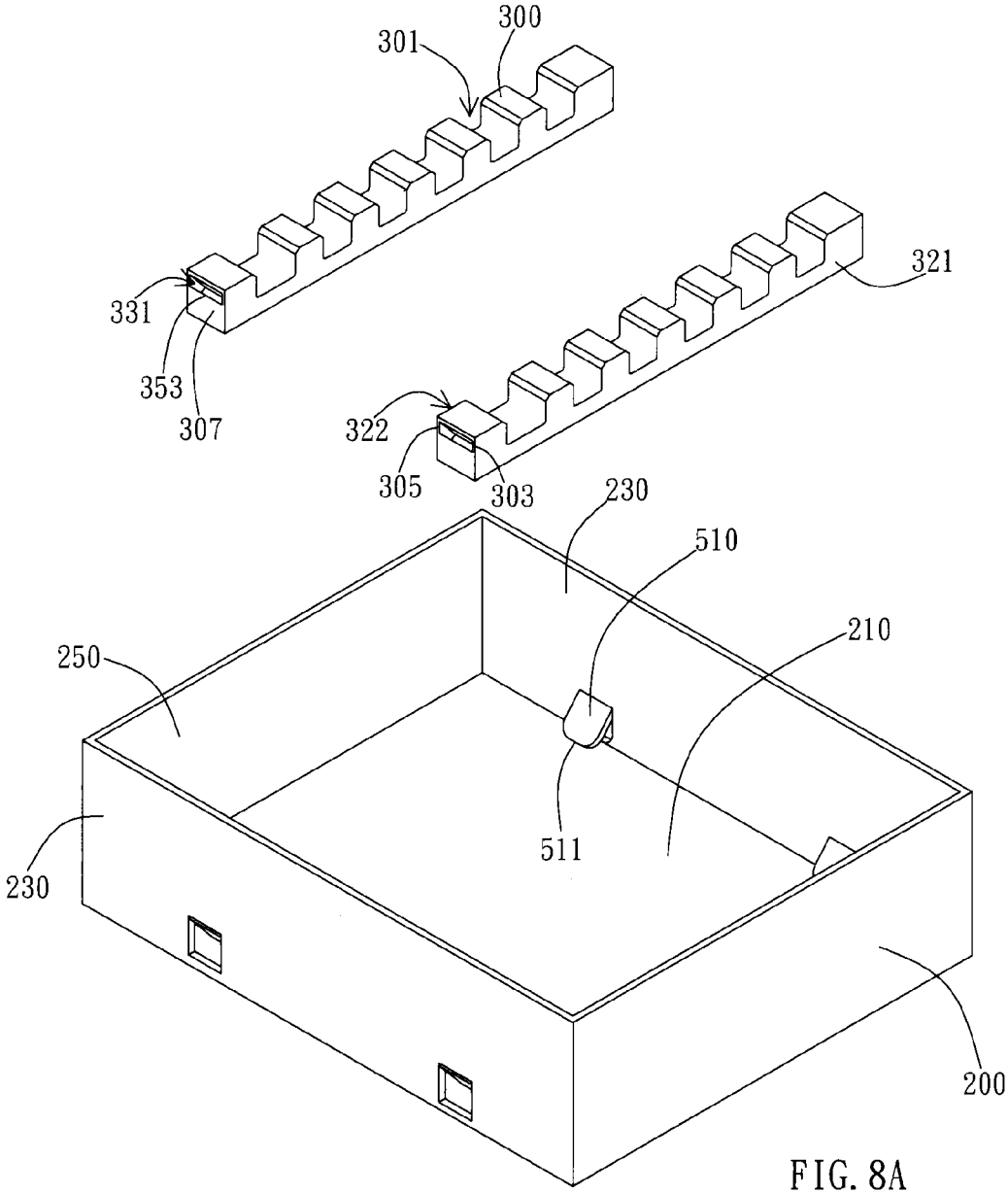
FIG. 8A and FIG. 8B are schematic views illustrating grooves in another embodiment.
Figure 8B:
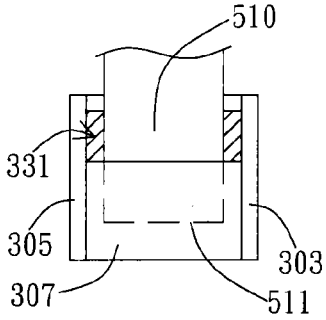

As FIG. 8A and FIG. 8B show, the length of the opening 331 of the groove 330 along a direction crossing the end portion 310 of the cushion portion 300 is smaller than the thickness of the end portion 310. Therefore the opening 331 is located on the end portion 310 and neither on the first stopper 321 and the second stopper 322. The opening 331 has a closed rim at the end portion while the inner surfaces of the first stopper 321 and the second stopper 322 form two inner walls of the groove 330. In the present embodiment, the thickness of the first tongue portion 510 is smaller than that of the cushion portion 300 so that the first tongue portion 510 can enter the opening 331. The inner surfaces of the first stopper 321 and the second stopper 322 respectively contact the first side 710 and the second side 720 of the first tongue plate 510 to clamp the first tongue plate 510. In this way, the first stopper 321 and the second stopper 322 are restricted from moving toward the first tongue plate 510 so that the relative distance between the cushion portion 300 and the sidewall 230 can be maintained.

Figure 8C:
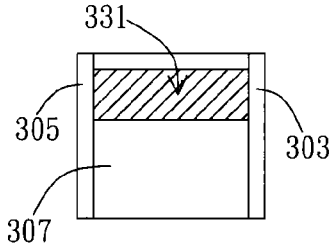
FIG. 8C is a schematic view of the cushion portion in another embodiment.

As FIG. 8C shows, the cushion portion 300 includes a first supporting plate 303, a second supporting plate 305, and a vibration-absorbing layer 307. The vibration absorbing layer 307 is disposed between the first supporting plate 303 and the second supporting plate 305 to form a sandwich plate structure. The rigidity of the vibration-absorbing layer 307 is smaller than that of the first supporting plate 303 and that of the second supporting plate 305 in order to provide better vibration-absorbing and buffer capacity. In a preferred embodiments, the vibration-absorbing layer 307 is made of expanded poly-propylene (EPP) with foaming rate of 15. However, in different embodiments, the vibration-absorbing layer 307 can be made of EPP with other foaming rate such as 30 and 45, organic resin, or rubber materials. The first supporting plate 303 and the second supporting plate 305 are made of EPP with foaming rate of 30. However, in different embodiments, the second supporting plate 305 can be made of EPP with other foaming rate such as 15 and 45 or other organic resin or rubber materials. As FIG. 8C shows, the first supporting plate 303 and the second supporting plate 305 form the first stopper 321 and the second stopper 322 respectively. Two sides of the first tongue plate 510 respectively contact the inner surfaces of the first supporting plate 303 and the second supporting plate 305.

Figure 9A:
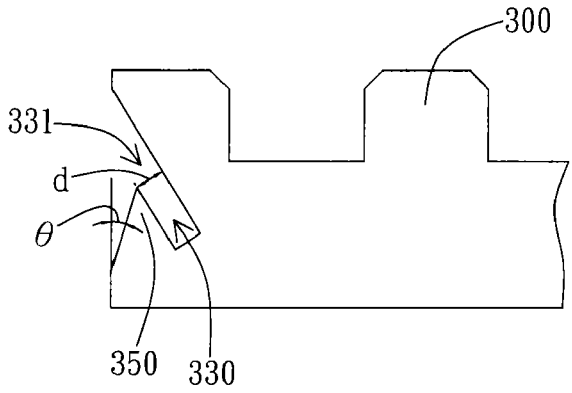
FIG. 9A, FIG. 9B and FIG. 9C are schematic views illustrating grooves in different embodiments.
Figure 9B:
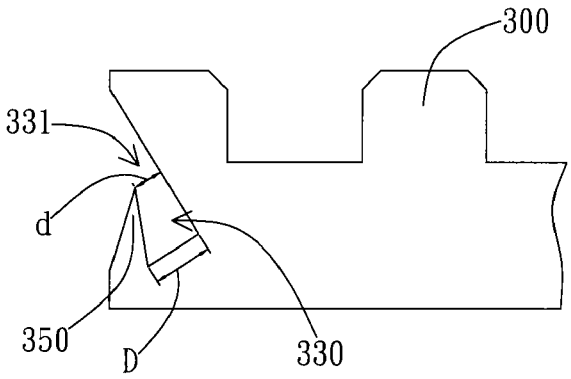

As FIG. 9A shows, the cross-section of the opening 331 of the groove 330 has an opening width d. In a preferred embodiment, the opening width d is not smaller than the thickness of the first tongue plate 510 and is preferably equal to the thickness of the first tongue plate 510. Furthermore, the cross-sectional widths of different sections of the groove 330 are kept the same to form a groove 330 with constant caliber. However, in the embodiment illustrated in FIG. 9B, the cross-sectional width of the groove 330 gradually increases from the opening 331 toward the bottom of the groove 330 so that the cross-sectional width D of the bottom is greater than the cross-sectional width d of the opening 331. Furthermore, the outer surface of the jaw portion 350 tilts at a lead angle θ from its bottom toward the groove 330 to facilitate the entrance and exit of the first tongue plate 510 through the opening 331.

Figure 9C:
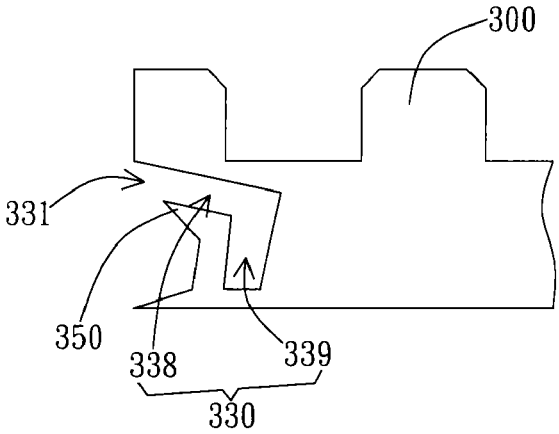

In the embodiment illustrated in FIG. 9C, the groove 330 is divided into a gateway section 338 and a transition section 339. The gateway section 338 is the portion of the groove 330 extending inward from the opening 331 while the transition section 339 is the portion of the groove 330 closer to the bottom. The transition section 339 communicates with the gateway section 338 and bends at the gateway section 338 by an angle. In a preferred embodiment, the first tongue plate 510 enters the gateway section 338 and contacts the inner surface of the groove 330 where the gateway section 338 communicates with the transition section 339. As FIG. 9C shows, the transition section 339 is located at the backside of the jaw portion 350 to provide the jaw portion 350 with a retreat space when pressed inward.

Figure 10:
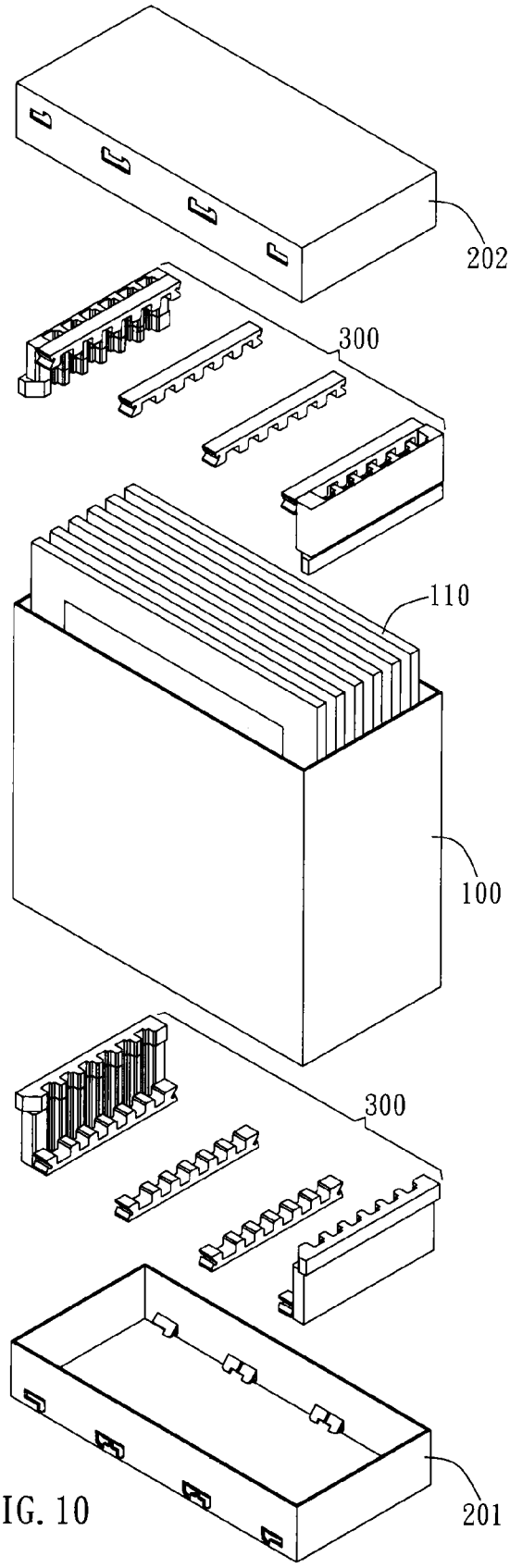
FIG. 10 is a schematic view illustrating the packing structure having a container.

As FIG. 10 shows, the packing structure further includes an outer casing 100. A first housing 201 and a second housing 202 are disposed on two opposite ends of the casing 100. The first housing 201 and the second housing 202 are coupled with the cushion portion 300 by means of the tongue plate and the groove described above. When display panels 110 or other items about to be boxed or transported are placed in the casing, the cushion portion 300 located at two ends of the casing 100 can provide the display panels 110 or other items protection in different directions and reduce the impact by external forces. Furthermore, trough on the cushion portion 300 can be used to position the display panels 110 or other items.

Figure 11:
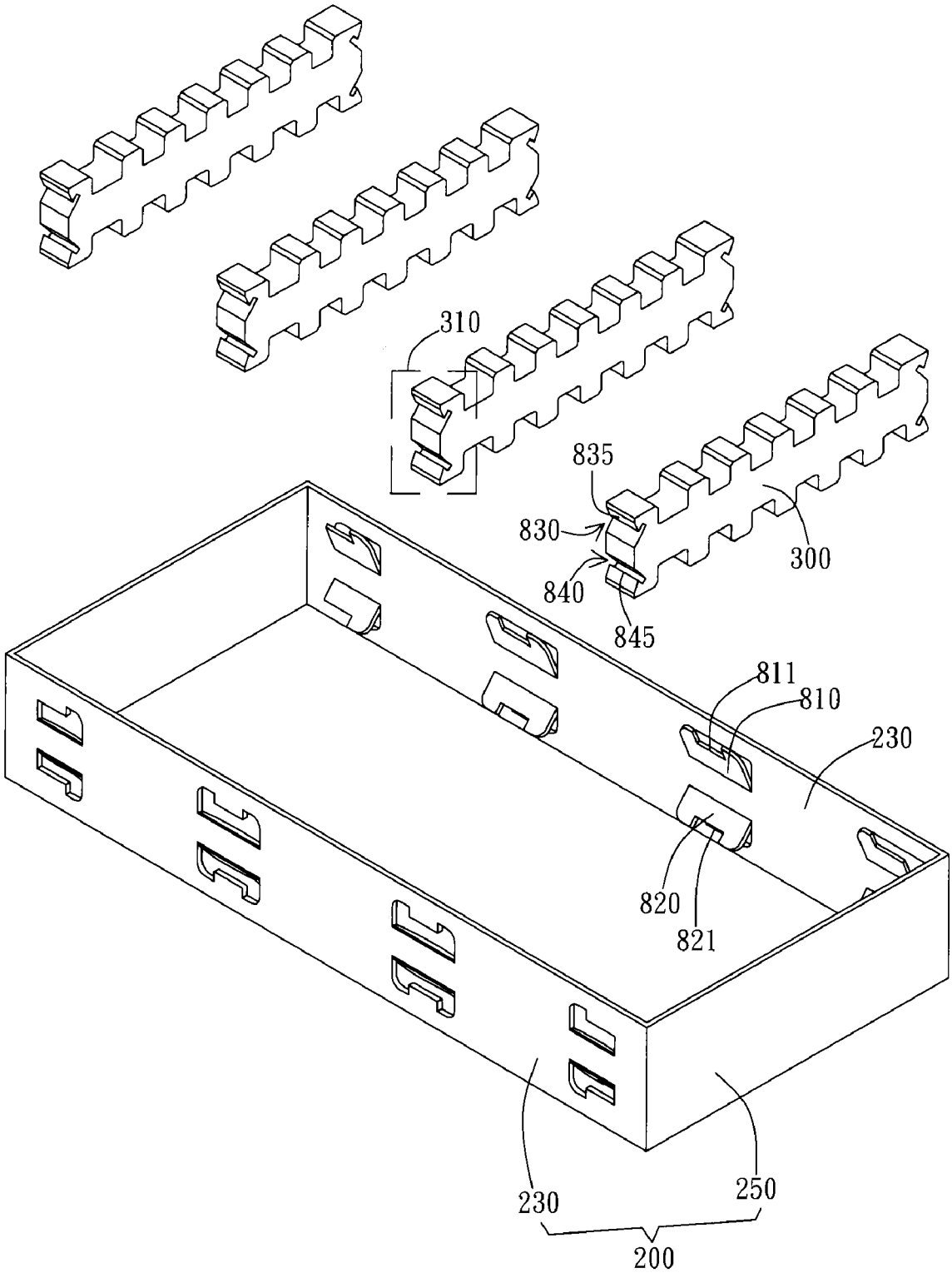
FIG. 11 is a schematic view illustrating the container and the cushion portion in another embodiment of the present invention.

In the embodiment illustrated in FIG. 11, the housing 200 is not disposed with a bottom plate 210 and is formed by encircling the side wall 230 and the back wall 250. The difference between the present embodiment and the above-mentioned embodiments is that an upper tongue plate 810 and a lower tongue plate 820 are formed on the side wall 230. The upper tongue plate 810 and the lower tongue plate 820 have similar structure with the first tongue plate 510. However, the upper tongue plate 810 and the lower tongue plate 820 are collinear with each other, i.e. the upper tongue plate 810 and the lower tongue plate 820 extend into directions that are collinear with each other. The collinear relationship between the tongue plates 810, 820 exists before the tongue plates 810, 820 bend inward. A first free end 811 of the upper tongue plate 810 and a second free end of the lower tongue plate 820 extend in different directions and both tilt toward the inner side of the housing 200. An upper groove 830 and a lower groove 840 are formed on the end portion 310 of the cushion portion 300 and correspond to the upper tongue plate 810 and the lower tongue plate 830, respectively. An upper jaw portion 835 and a lower jaw portion 845 are formed on the upper groove 830 and the lower groove 840, respectively and both face one side of the side wall 230. The upper tongue plate 810 and the lower tongue plate 820 extend in different directions. Therefore the upper jaw portion 835 and the lower jaw portion 845 extend in opposite directions corresponding to the upper and lower tongue plate 810, 820 and form openings of the upper groove 830 and the lower groove 840.

Figure 12A:
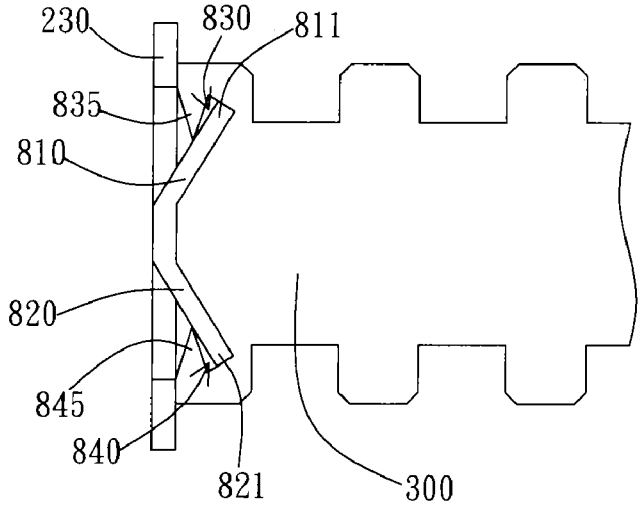
FIG. 12A is a cross-sectional view illustrating the upper tongue plate and the lower tongue plate in another embodiment.

In the embodiment illustrated in FIG. 12A, the upper tongue plate 810 and the lower tongue plate 820 respectively extend from the side wall 230 to form the first free end 811 and the second free end 821. The upper jaw portion 835 and the lower jaw portion 845 extend in different directions and correspond to the first free end 811 and the second free end 821, respectively. In other words, the upper tongue plate 810 and the lower tongue plate 820 extend outward form the side wall 230 and respectively enter the openings of the upper groove 830 and the lower groove 840. The upper jaw portion 835 and the lower jaw portion 845 respectively interfere with the upper tongue plate 810 and the lower tongue plate 820 to restrict the upper tongue plate 810 and the lower tongue plate 820 from entering the upper groove 830 and the lower groove 840. The relationship between the upper tongue plate 810 and the upper groove 830 is similar with that between the first tongue plate 510 and the groove 330. Similarly, the relationship between the lower tongue plate 820 and the lower groove 840 is similar with that between the first tongue plate 510 and the groove 330. The upper tongue plate 810 and the lower tongue plate 820 restrict the displacement of the cushion portion 300 moving upward and downward, and therefore even if the housing 200 without the bottom plate 210 can restrict the vertical displacement of the cushion portion 300. The displacement of the cushion portion 300 in lateral directions can also be restricted as described above.

Figure 12B:
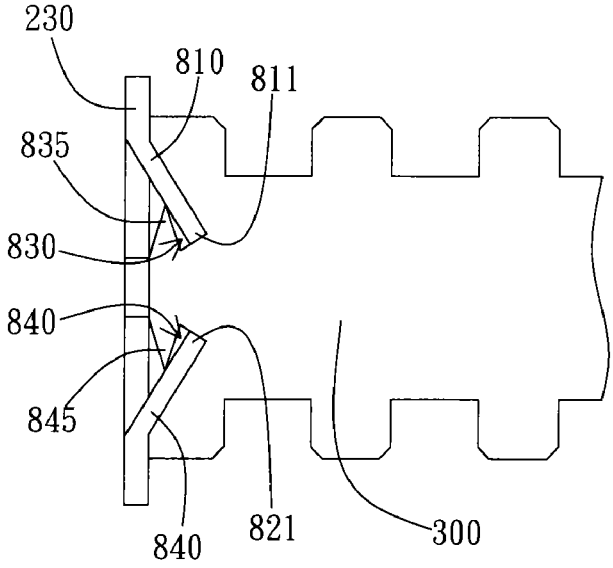
FIG. 12B is a cross-sectional view illustrating the upper tongue plate and the lower tongue plate in yet another embodiment.

In the embodiment illustrated in FIG. 12B, the upper tongue plate 810 and the lower tongue plate 820 respectively extend toward each other from the side wall 230 to form the first free end 811 and the second free end 821. The upper jaw portion 835 and the lower jaw portion 845 extend in different directions to correspond to the first free end 811 and the second free end 821, respectively. In other words, the upper tongue plate 810 and the lower tongue plate 820 extend inward and toward each other. The upper tongue plate 810 and the lower tongue plate 820 extend in opposite directions toward each other before the two tongue plate 810, 820 bend toward the inner side of the housing 200.

Figure 13:
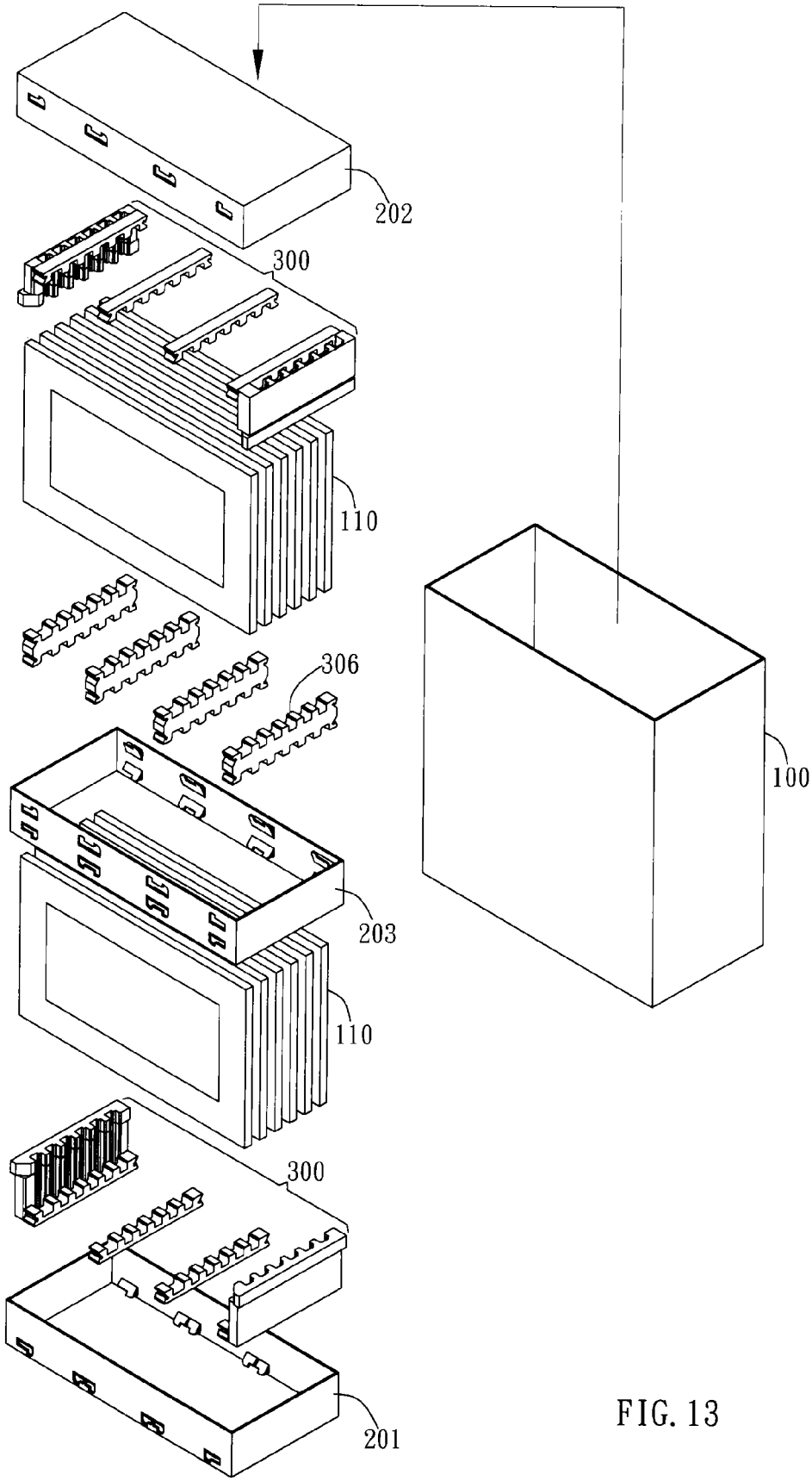
FIG. 13 is a schematic view illustrating the inner housing and the container in another embodiment.

As FIG. 13 shows, when the upper tongue plate 810, the lower tongue plate 820 are coupled with the casing 100, the cushion portions 300 can be used as buffers for the display panels 110. In addition to the combination of the first housing 201, the second housing 202 and the cushion portion 300, a hollow middle housing 203 without the bottom plate can be disposed between two rows of display panels 110. The middle housing 203 have the structure of above-mentioned upper tongue plate 810 and lower tongue plate 820 for coupling with a middle cushion portion 306. When the display panel 110 or other items to be boxed or transported are disposed in the casing 100, the middle cushion portion 306 between two rows of display panels can be used to provide the display panels 110 or other items protection in different directions in order to reduce impact from external forces. Furthermore, the troughs on the middle cushion portion 306 can be used to position the display panels 110 or other items.

The above is a detailed description of the particular embodiment of the invention which is not intended to limit the invention to the embodiment described. It is recognized that modifications within the scope of the invention will occur to a person skilled in the art. Such modifications and equivalents of the invention are intended for inclusion within the scope of this invention.

What is claimed is:

1. A packing structure, comprising:

a housing, including:

a bottom plate; and a sidewall connected to the bottom plate together to include an angle, wherein a first tongue plate is formed on the sidewall, the first tongue plate bends inward and has a free end extending obliquely toward the bottom plate; and a cushion portion disposed on the bottom plate, the cushion portion having an end portion, a groove being formed on the end portion into the cushion portion and tilting toward the bottom plate and a jaw portion being located on a side of the groove facing the sidewall, wherein the jaw portion extends away from the bottom plate and has an outer surface substantially facing the sidewall and a back surface substantially opposite to the outer surface, the back surface of the law portion serves as an inner surface of the groove, a top end of the jaw portion and an end portion of the cushion together form an opening of the groove, wherein the first tongue plate enters the groove through the opening, the jaw portion interferes with the first tongue plate to restrict the first tongue plate from leaving the groove, the free end of the first tongue plate contacts an inner surface of the groove to limit a displacement of the cushion portion away from the bottom plate, a first side of the first tongue plate contacts a first stopper of the cushion portion and limits a displacement of the cushion portion.

2. The packing structure of claim 1, wherein the jaw portion is elastic, the first tongue plate compels the jaw portion to deform so as to enter the groove.

3. The packing structure of claim 1, wherein a second tongue plate is formed on the sidewall and adjacent to the first tongue plate, a bridging portion is disposed between the first tongue plate and the second tongue plate to connect portions of the sidewall above and below the first tongue plate and the second tongue plate, the second tongue plate bends inward and has a free end extending obliquely toward the bottom plate, the second tongue plate enters the groove through the opening, the jaw portion interferes with the second tongue plate to restrict the second tongue plate from leaving the groove, the free end of the second tongue plate contacts a bottom surface of the groove to limit the displacement of the cushion portion away from the bottom plate, a second side of the second tongue plate contacts a second stopper of the cushion portion opposite to the first stopper and limits the displacement of the cushion portion.

4. The packing structure of claim 1, wherein the groove on the first side has a lateral opening communicating with the opening, a first protruding portion is formed on the first side of the first tongue plate and protrudes from the free end, the first side protrudes out from the lateral opening while the first protruding portion contacts an outer surface of the first stopper near the groove to limit the displacement of the cushion portion toward the first protruding portion.

5. The packing structure of claim 4, wherein the first tongue plate includes a second side opposite to the first side, a second protruding portion is formed on the second side and protrudes from the free end, the second protruding portion contacts a second stopper opposite to the first stopper and limits the displacement of the cushion portion toward the second stopper, the first protruding portion and the second protruding portion together clamp the cushion portion.

6. The packing structure of claim 4, wherein the housing includes a back wall perpendicular to the bottom plate and the sidewall, the cushion portion has a second stopper opposite to the first stopper, the second stopper contacts the back wall so that the back wall and the first protruding portion together clamp the cushion portion.

7. The packing structure of claim 6, wherein a third tongue plate is formed on the back wall and bends inward, the third tongue plate has a free end extending obliquely toward the bottom plate, a backside groove is formed on the second stopper and a backside jaw portion is formed on a side of the backside groove facing the back wall, wherein the backside jaw portion extends away from the bottom plate, a top end of the backside jaw portion and the second stopper together form a backside opening of the backside groove, the third tongue plate enters the backside groove through the backside opening, the backside jaw portion interferes with the third tongue plate to restrict the third tongue plate from leaving the backside groove, the free end of the third tongue plate contacts an inner surface of the backside groove and limits the displacement of the cushion portion away from the bottom plate.

8. The packing structure of claim 1, wherein the first stopper is formed on one side of the groove, the first side of the first tongue plate contacts an inner surface of the first stopper inside the groove and limits a displacement of the first stopper toward the first tongue plate.

9. The packing structure of claim 1, wherein an opening width of the opening is not smaller than a thickness of the first tongue plate.

10. The packing structure of claim 9, wherein a cross-sectional width of the groove gradually increases from the opening toward a bottom of the groove.

11. The packing structure of claim 1, wherein the groove includes a gateway section and a transition section, the transition section communicates with the gateway section and bends at the gateway section by an angle, the first tongue plate enters the gateway section, the transition section is located at a backside of the jaw portion to provide the jaw portion with a retreat space.

12. The packing structure of claim 1, wherein an outer surface of the jaw portion tilts at a lead angle from the sidewall of the housing toward the groove.

13. The packing structure of claim 3, 5, 6 or 7, wherein the cushion portion includes:

a first supporting plate forming the first stopper;

a second supporting plate being parallel with the first supporting plate and forming the second stopper; and a vibration-absorbing layer disposed between the first supporting plate and the second supporting plate, wherein a rigidity of the vibration-absorbing layer is smaller than a rigidity of the first supporting plate and the second supporting plate.

14. A packing structure, comprising:

a housing formed by an encircled side wall, the side wall being disposed with:

an upper tongue plate having a first free end, wherein the upper tongue plate bends to allow the first free end to tilt toward the housing; and a lower tongue plate, disposed collinearly with the upper tongue, having a second free end extending in a direction different from the first free end, wherein the lower tongue plate bends to allow the second free end to tilt toward the housing; and a cushion portion having an end portion, an upper groove and a lower groove are formed on the end portion respectively corresponding to the upper tongue plate and the lower tongue plate, an upper jaw portion and a lower jaw portion are respectively formed on the upper groove and the second groove facing the sidewall, wherein the upper jaw portion and the lower jaw portion extend in opposite directions and form openings of the upper groove and the lower groove with the end portion of the cushion portion, wherein the upper tongue plate and the lower tongue plate respectively enter the upper groove and the lower groove through the openings, the upper jaw portion and the lower jaw portion respectively interfere with the upper tongue plate and the lower tongue plate to restrict the upper tongue plate and the lower tongue plate from leaving the upper groove and the lower groove, the free ends of the upper tongue plate and the lower tongue plate respectively contact inner surfaces of the upper groove and the lower groove to limit a displacement of the cushion portion along the upper tongue plate and the lower tongue plate, a side of the upper tongue plate contacts a stopper of the cushion portion to limits a displacement of the cushion portion.

15. The packing structure of claim 14, wherein the upper jaw portion and the lower jaw portion are elastic, the upper tongue plate and the lower tongue plate respectively compel the upper jaw portion and the lower jaw portion to deform so as to respectively enter the upper groove and the lower groove.

16. The packing structure of claim 14, wherein the upper tongue plate and the lower tongue plate extend from the side wall in opposite directions to form the first free end and the second free end, the upper jaw portion and the lower jaw portion extend toward each other to respectively correspond to the first free end and the second free end.

17. The packing structure of claim 14, wherein the upper tongue plate and the lower tongue plate extend toward each other to form the first free end and the second free end, the upper jaw portion and the lower jaw portion extend in opposite directions to correspond to the first free end and the second free end.

18. A packing structure, comprising:

a container;

a first housing and a second housing, disposed toward each other on two opposite ends of the container, the first housing and the second housing respectively include:

a bottom plate; and a sidewall connected to the bottom plate to together include an angle, wherein a first tongue is formed on the sidewall, the first tongue plate bends inward and has a free end extending toward the bottom plate; and a cushion portion disposed on the bottom plate, the cushion portion having an end portion, a groove being formed on the end portion and a jaw portion being located on a side of the groove facing the sidewall, wherein the jaw portion extends away from the bottom plate, a top end of the jaw portion and an end of the cushion together form an opening of the groove, wherein the first tongue plate enters the groove through the opening, the jaw portion interferes with the first tongue plate to restrict the first tongue plate from leaving the groove, the free end of the first tongue plate contacts an inner surface of the groove to limit a displacement of the cushion portion away from the bottom plate, a first side of the first tongue plate contacts a first stopper of the cushion portion and limits a displacement of the cushion portion.

19. The packing structure of claim 18, wherein the jaw portion is elastic, the first tongue plate compels the jaw portion to deform so as to enters the groove.

20. The packing structure of claim 18, wherein a second tongue plate is formed on the sidewall and adjacent to the first tongue plate, a bridging portion is disposed between the first tongue plate and the second tongue plate to connect portions of the sidewall above and below the first tongue plate and the second tongue plate, the second tongue plate bends inward and has a free end extending obliquely toward the bottom plate, the second tongue plate enters the groove through the opening, the jaw portion interferes with the second tongue plate to restrict the second tongue plate from leaving the groove, the free end of the second tongue plate contacts a bottom of the groove to limit the displacement of the cushion portion away from the bottom plate, a second side of the cushion portion contacts a second stopper of the cushion portion opposite to the first stopper and limits a displacement of the cushion portion.

21. The packing structure of claim 18, wherein the groove on the first side has a lateral opening communicating with the opening, a first protruding portion is formed on the first side of the first tongue plate and protrudes form the free end, the first side protrudes out from the lateral opening while the first protruding portion contacts an outer surface of the first stopper near the groove to limit the displacement of the cushion portion toward the first protruding portion.

22. The packing structure of claim 21, wherein the first tongue plate includes a second side opposite to the first side, a second protruding portion is formed on the second side and protrudes from the free end, the second protruding portion contacts a second stopper opposite to the first stopper and limits a displacement of the cushion portion toward the second stopper, the first protruding portion and the second protruding portion together clamp the cushion portion.

23. The packing structure of claim 21, wherein the housing includes a back wall perpendicular to the bottom plate and the sidewall, the cushion portion has a second stopper opposite to the first stopper, the second stopper contacts the back wall so that the back wall and the first protruding portion together clamp the cushion portion.

24. The packing structure of claim 23, wherein a third tongue plate is formed on the back wall and bends inward, the third tongue plate has a free end extending obliquely toward the bottom plate, a backside groove is formed on the second stopper and a backside jaw portion is formed on a side of the backside groove facing the back wall, wherein the backside jaw portion extends away from the bottom plate, a top end of the back jaw portion and the second stopper together form a backside opening of the backside groove, the third tongue plate enters the backside groove through the backside opening, the backside jaw portion interferes with the third tongue plate to restrict the third tongue plate from leaving the backside groove, the free end of the third tongue plate contacts an inner surface of the backside groove and limits a displacement of the cushion in a direction away from the bottom plate.

25. The packing structure of claim 18, wherein the first stopper is formed on one side of the groove, the first side of the first tongue plate contacts an inner surface of the first stopper inside the groove and limits a displacement of the first stopper toward the first tongue plate.

26. The packing structure of claim 18, wherein an opening width of the opening is not smaller than a thickness of the first tongue plate.

27. The packing structure of claim 26, wherein a cross-sectional width of the groove gradually increases from the opening toward a bottom of the groove.

28. The packing structure of claim 18, wherein the groove includes a gateway section and a transition section, the transition section communicates with the gateway section and bends at the gateway section at an angle, the first tongue plate enters the gateway section, the transition section is located at a backside of the jaw portion to provide the jaw portion with a retreat space.

29. The packing structure of claim 18, wherein an outer surface of the jaw portion tilts at a lead angle from the sidewall of the housing toward the groove.

30. The packing structure of claim 20, 22, 23 or 24, wherein the cushion portion includes:

a first supporting plate forming the first stopper;

a second supporting plate being parallel with the first supporting plate and forming the second stopper; and a vibration-absorbing layer disposed between the first supporting plate and the second supporting plate, wherein a rigidity of the vibration-absorbing layer is smaller than a rigidity of the first supporting plate and that of the second supporting plate.

31. The packing structure of claim 18 further comprising:

a middle housing formed by an encircled middle side wall and located between the first housing and the second housing, the middle housing being disposed with:

an upper tongue plate having a first free end, wherein the upper tongue plate bends to allow the first free end to tilt toward the middle housing; and a lower tongue plate, disposed collinearly with the upper tongue, having a second free end extending in a direction different from the first free end, wherein the lower tongue plate bends to allow the second free end to tilt toward the middle housing; and a middle cushion portion having an end portion, an upper groove and a lower groove are formed on the end portion respectively corresponding to the upper tongue plate and the lower tongue plate, an upper jaw portion and a lower jaw portion are respectively formed on the upper groove and the second groove facing the sidewall, wherein the upper jaw portion and the lower jaw portion extend in opposite directions and form openings of the upper groove and the lower groove with the end portion of the cushion portion;

wherein the upper tongue plate and the lower tongue plate respectively enter the upper groove and the lower groove through the openings, the upper jaw portion and the lower jaw portion respectively interfere with the upper tongue plate and the lower tongue plate to restrict the upper tongue plate and the lower tongue plate from leaving the upper groove and the lower groove, the free ends of the upper tongue plate and the lower tongue plate respectively contact inner surfaces of the upper groove and the lower groove respectively to limit the displacement of the cushion portion along the upper tongue plate and the lower tongue plate, a side of the upper tongue plate contact a stopper of the cushion portion to limits a displacement of the cushion portion.

32. The packing structure of claim 31, wherein the upper jaw portion and the lower jaw portion are elastic, the upper tongue plate and the lower tongue plate respectively compel the upper jaw portion and the lower jaw portion to deform so as to respectively enter the upper groove and the lower groove.

33. The packing structure of claim 31, wherein the upper tongue plate and the lower tongue plate extends from the side wall in opposite directions to form the first free end and the second free end, the upper jaw portion and the lower jaw portion extend toward each other to respectively correspond to the first free end and the second free end.

34. The packing structure of claim 31, wherein the upper tongue plate and the lower tongue plate extend toward each other to form the first free end and the second free end, the upper jaw portion and the lower jaw portion extend in opposite directions to correspond to the first free end and the second free end.

35. A packing structure, comprising:

a housing, including:

a bottom plate; and a sidewall connected to the bottom plate together to include an angle, wherein a first tongue plate is formed on the sidewall, the first tongue plate bends inward and has a free end extending obliquely toward the bottom plate; and a cushion portion disposed on the bottom plate, the cushion portion having an end portion, a groove being formed on the end portion into the cushion portion and tilting toward the bottom plate and a jaw portion being located on a side of the groove facing the sidewall and protruding from the end portion, wherein the jaw portion extends away from the bottom plate, a top end of the jaw portion and the end portion of the cushion together form an opening of the groove, wherein the first tongue plate enters the groove through the opening, the jaw portion interferes with the first tongue plate to restrict the first tongue plate from leaving the groove, the free end of the first tongue plate contacts an inner surface of the groove to limit a displacement of the cushion portion away from the bottom plate, a first side of the first tongue plate contacts a first stopper of the cushion portion and limits a displacement of the cushion portion.

* * * * *